United States Patent [19]

Tamura

[11] Patent Number: 4,488,718

[45] Date of Patent: Dec. 18, 1984

[54] SHEET FEEDING MEANS

[75] Inventor: Takashi Tamura, Hachioji, Japan

[73] Assignee: Konishirku Photo Industry Co., Ltd., Tokyo, Japan

[21] Appl. No.: 386,624

[22] Filed: Jun. 9, 1982

[30] Foreign Application Priority Data

Jun. 18, 1981 [JP] Japan ..... 56-93052

[51] Int. Cl.[3] ..... B65H 1/14; B65H 3/06

[52] U.S. Cl. ..... 271/127; 271/160; 271/162; 271/118

[58] Field of Search ..... 271/127, 126, 160–164, 271/170, 171, 118

[56] References Cited

U.S. PATENT DOCUMENTS 4,025,066 5/1977 Sue ..... 271/9
4,319,742 3/1982 Ulseth ..... 271/118
4,346,878 8/1982 Aizawa ..... 271/118

*Primary Examiner*—Bruce H. Stoner, Jr.

*Assistant Examiner*—James E. Barlow

*Attorney, Agent, or Firm*—Jordan B. Bierman

[57] ABSTRACT

A sheet feeding device for an electrophotographic copying machine and the like has a flapping up member which protrudes through the bottom of a sheet feeding cassette to bring the sheets thereon into contact with a sheet feeding roller. The flapping up member is moved by a driven lever which is in turn moved by a low-tension biasing member in the direction of flapping the bottom plate up upon receipt of a sheet feeding commencement signal. A restrain member energized by a high-tension biasing member is provided to restrain the flapping up member to the retreated position upon termination of the sheet feeding commencing signal whereby the sheet feeding cassette is not affected by any resistance at the time of insertion or removal of the cassette and the bottom plate of the cassette is automatically flapped up only while sheet feeding is being operated.

2 Claims, 5 Drawing Figures

SHEET FEEDING MEANS

BACKGROUND OF THE INVENTION

1. Field of the Invention

The present invention relates to a sheet feeding means to be used in a machine for rotating an image on sheets such as an electrophotographic copying machine, and the like, and more particularly to a sheet feeding means of the type in which the sheet feeding is carried out by flapping up the bottom plate of a sheet feeding cassette on which sheets are loaded.

2. Description of the Prior Art

As is popularly known, a typical sheet feeding mechanism of an electrophotographic copying machine and the like has a bottom plate, in a sheet feeding cassette on which recording sheets are loaded. The bottom plate is flapped up toward a sheet feeding roller or the like to bring the upper sheet into contact with the sheet feeding roller, so as to perform the sheet feeding operation.

In the sheet feeding means of this kind, it is required to draw back a bottom plate flapping-up member from the sheet feeding cassette when said sheet feeding cassette is to be inserted in or to be detached from a sheet feeding table. To cope therewith, it is known to provide a manual lever in the sheet feeding table so as to control the posture of the sheet flapping-up member and by which said sheet flapping-up member is drawn back. Alternatively, a cam is provided onto the side surface of the sheet feeding cassette so as to control the posture of a sheet flapping-up member and by which said flapping-member is drawn back temporarily into the sheet feeding table. However, in the structure of the former countermeasure, the manual lever must be operated every time when the sheet feeding cassette is inserted or detached, so that a very awkward operation is compelled. Such a structure is known from Japanese Laid-open Patent Application No. 52-82237. And in the structure in the latter countermeasure, the sheet feeding cassette is affected by a considerable resistance at the time of insertion or detachment, and therefore, there are difficulties in the insertion and detachment of the sheet feeding cassette. There have also been taken such countermeasure in which a cam is provided onto a sheet feeding table as shown in Japanese Laid-open Patent Application No. 55-135033.

SUMMARY OF THE INVENTION

Taking the actual circumstances as mentioned above into consideration, the present invention hereby proposes a sheet feeding means in which a sheet feeding cassette is not affected at all by any of the resistance at the time of the insertion or detachment of said sheet feeding cassette and the bottom plate of the sheet feeding cassette is automatically flapped up only while sheet feeding is being operated.

BRIEF DESCRIPTION OF THE DRAWINGS

The above objects and other features and advantages of the invention are described in detail below in conjunction with the drawings, of which.

DETAILED DESCRIPTION OF THE PREFERRED EMBODIMENTS

Figure 4:
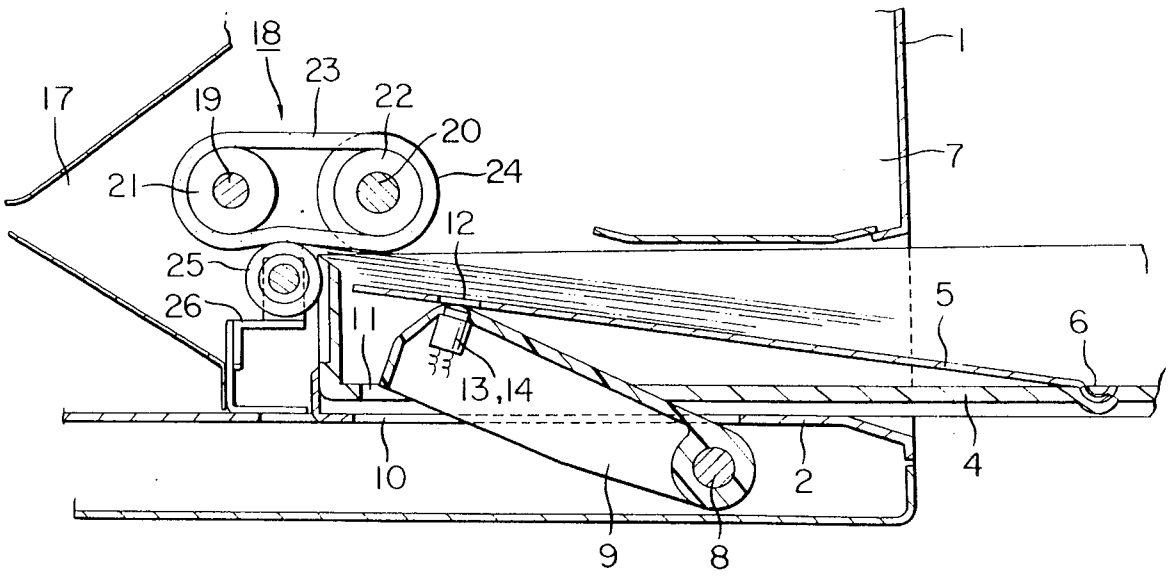
FIG. 4 is a sectional view of the sheet feeding means in FIG. 1 during a sheet feeding condition.

The example of the invention is described with reference to the drawings, as follows:

The example illustrated herein is for a sheet feeding section of an electrophotographic copying machine embodying the invention, wherein sheet feeding cassette 4 can be inserted from opening 3 into sheet feeding table 2 of the electrophotographic copying machine generally referred to numeral 1. Sheet feeding cassette 4 has the bottom plate 5, i.e., a loading plate, as shown in FIG. 4, for loading a plurality of sheets, i.e., recording paper X in a piled state, and said bottom plate 5 can be flapped upward around support hinge 6 as the center.

Figure 1:
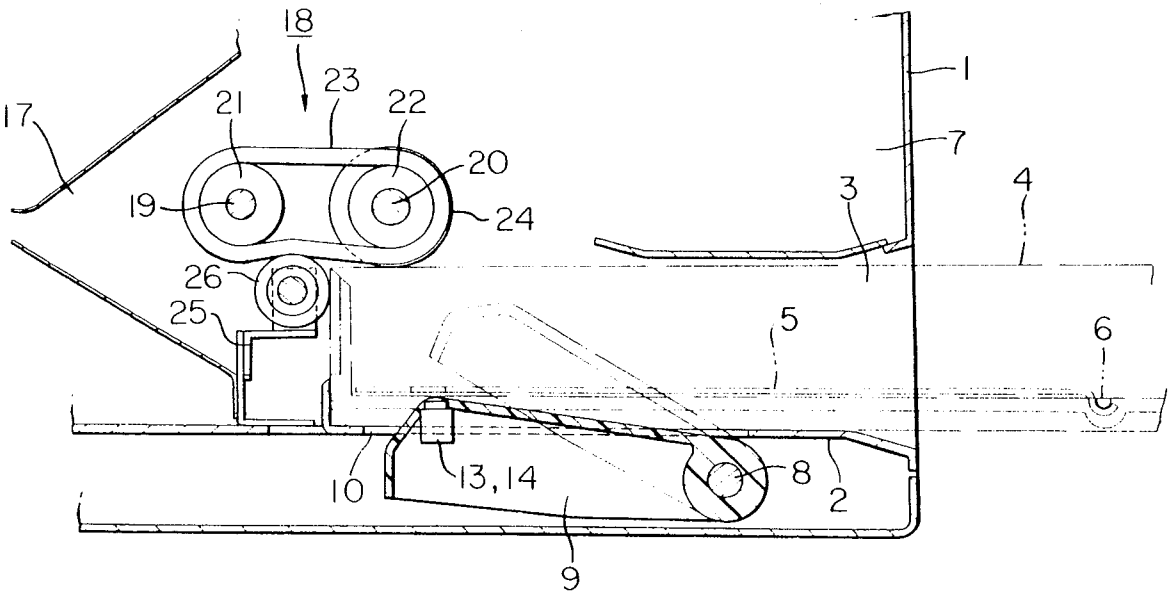
FIG. 1 is a sectional view of the sheet feeding means of the present invention used in an electrophotographic copying machine.
Figure 5:
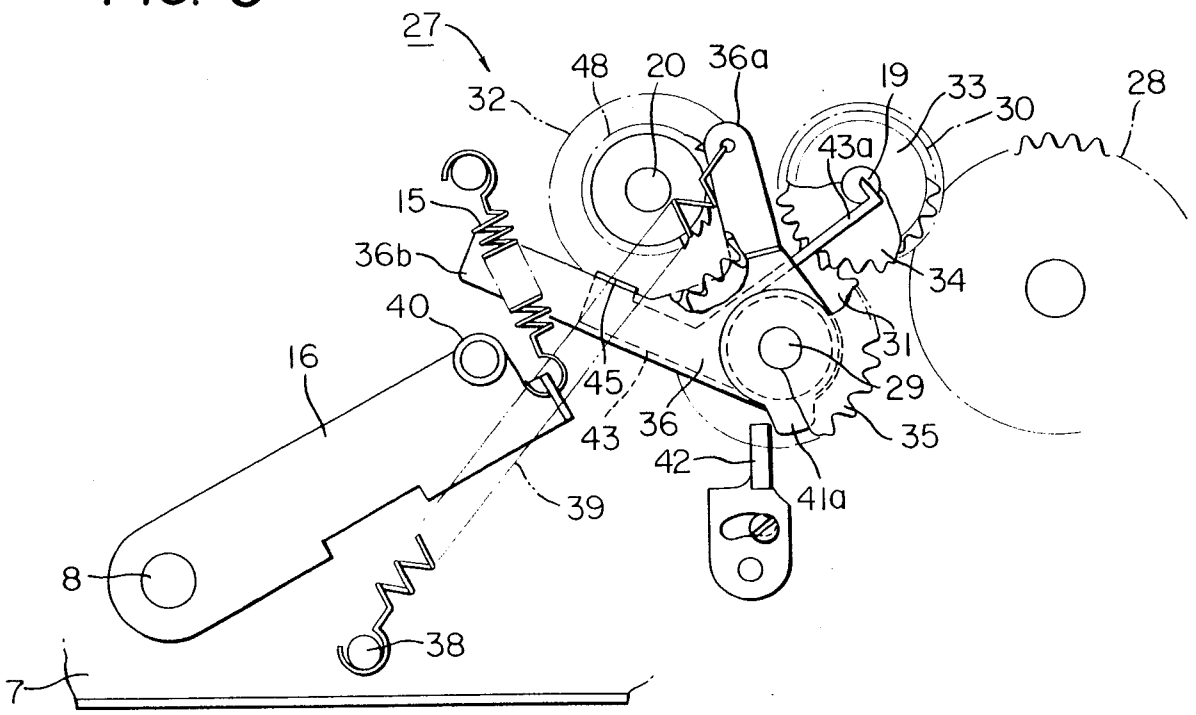
FIG. 5 is a sectional view of the apparatus in FIG. 2 during a sheet feeding condition.

In FIG. 1, underneath sheet feeding table 2 there is positioned a support hinge shaft 8 which is fixed to the sides of frame 7 and the base of flapping-up member 9 is fixed to the center of said support hinge shaft 8. Said flapping-up member 9 protrudes into said sheet feeding cassette 4 through both the opening 10 of sheet feeding table 2 and cut-out 11 (which is shown in FIG. 4) of sheet feeding cassette 4 to flap up said bottom plate 5. Also, to the front end portion of said flapping-up member 9, a detector for detecting recording sheet X loaded on the bottom plate 5 is fixed. For the purpose of detecting, a peep-hole 12 is opened in a part of the bottom plate and light emitting device 13 and phototransistor 14 are fixed to the front end of flapping-up member 9 positionally corresponding to said peep-hole 12 so that the irradiation fields and photoreception fields is directed through said peep-hole 12. Accordingly, when bottom plate 5 is flapped up as shown in FIG. 4, recording sheet X on the bottom plate 5 is illuminated by the light emitting device 13 and the reflective light therefrom becomes incident upon phototransistor 14, so that it is possible to confirm the presence of recording paper X. And, driven lever 16 is fixed to the end of aforesaid support hinge shaft 8 as shown in FIG. 2 and FIG. 5 so as to be energized by tension spring 15 and to be posture-controlled by means of a control unit which will be described later.

Referring back to FIG. 1, sheet feeding unit 18 is positioned at the upper part of the inside of aforesaid sheet feeding table 2 so as to send out recording sheet X one after another from the inside of sheet feeding cassette 4 into sheet feeding passage 17. This sheet feeding unit 18 is mounted to belt-driving shaft 19 and roller-driving shaft 20 which are in parallel with each other and are installed between the sides of frame 7. Said unit 18 is equipped with conveyor belt 23 suspended over driving pulley 21 which is fixed to aforesaid belt-driving shaft 19 and driven pulley 22 which is slipped idlewise on the roller-driving shaft 20. Sheet feeding roller 24 is fixed to said roller-driving shaft 20 so that recording sheet X in sheet feeding cassette 4 can be brought into pressure contact with said sheet feeding roller 24. Peeling-off member 26 is fixedly supported by mounting plate 25 and is in rolling contact with the surface of conveyor belt 23. Accordingly, when bottom plate 5 of the sheet feeding cassette 4 is flipped-up, then recording sheet X is drawn out from sheet feeding cassette 4 by the revolving motion of sheet feeding roller 24 to be transferred toward sheet feeding passage 17 by the motion of conveyor belt 23. Then, if a plural number of sheets are to be fed, the upper-most recording sheet is peeled off from the other sheets by peeling-off member 26, so that only said upper-most recording sheet is sent out to the sheet feeding passage 17.

Figure 2:
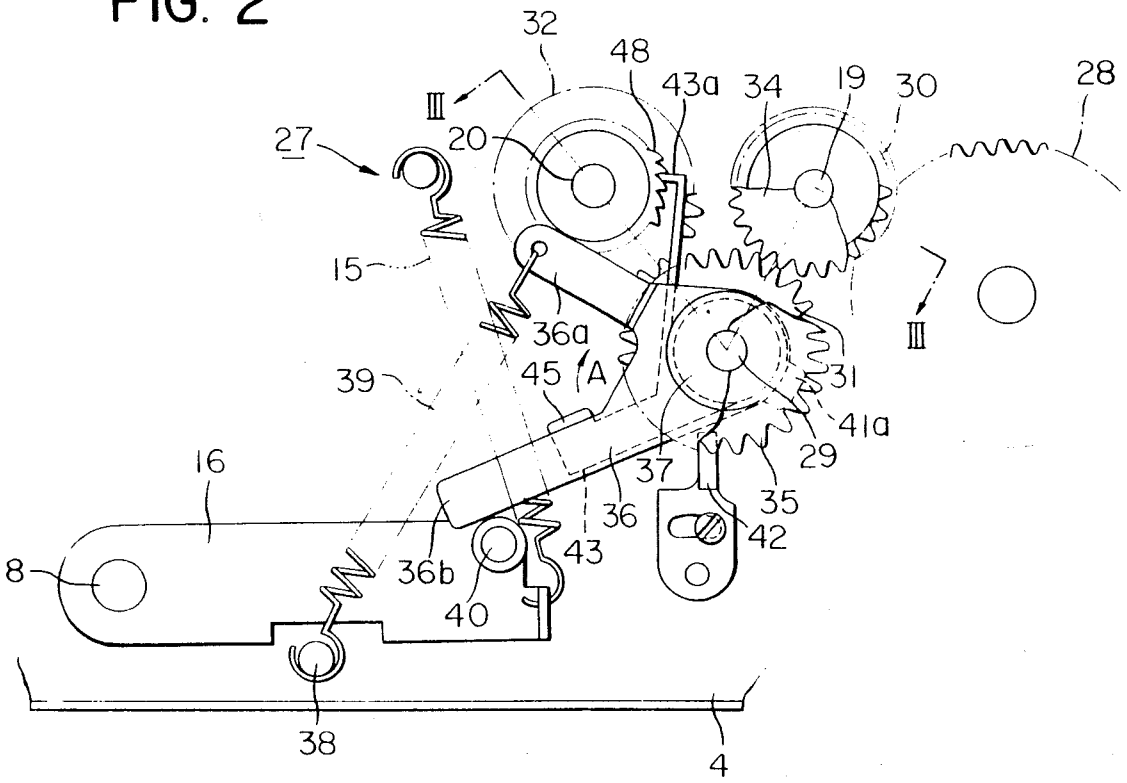
FIG. 2 is a side view of the apparatus of FIG. 1 in the absence of a sheet feeding condition.
Figure 3:
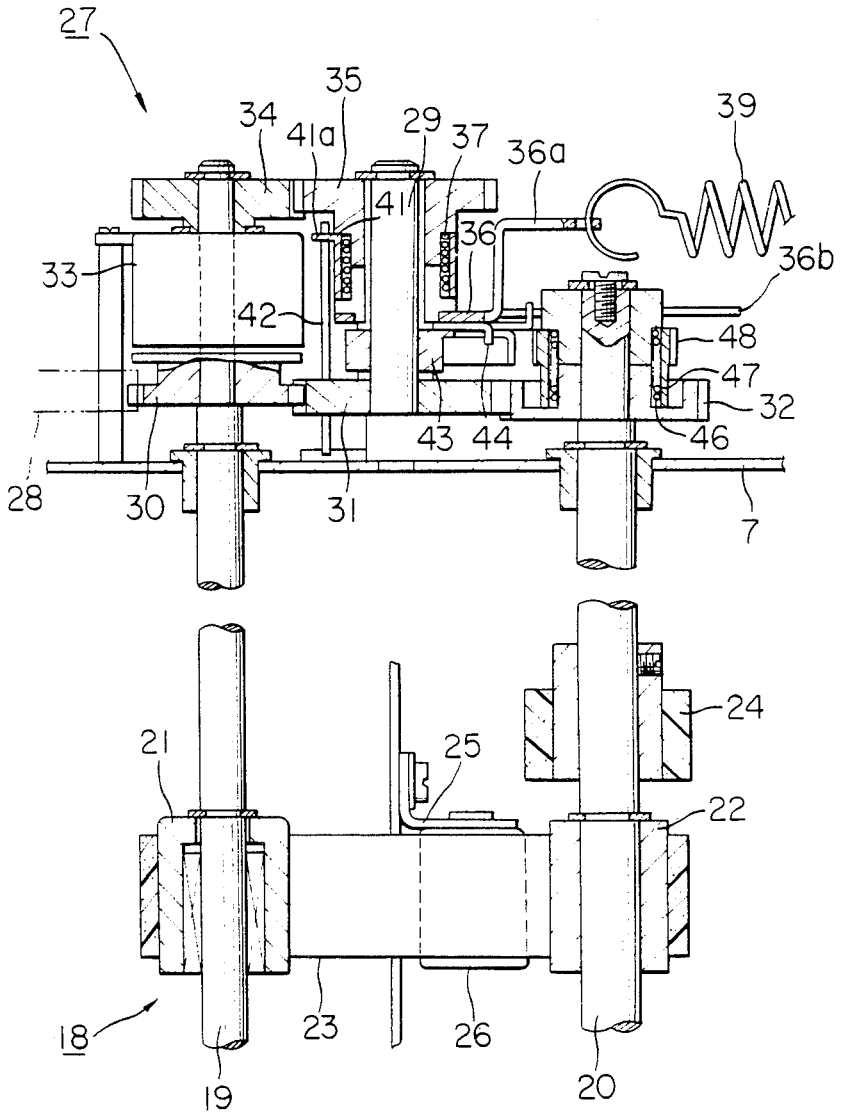
FIG. 3 is a sectional view taken along line III—III of FIG. 2.

FIG. 2 and FIG. 3 illustrate control unit 27 respectively, wherein aforesaid driven lever 16, belt-driving shaft 19 and roller-driving shaft 20 are controlled. The control unit 27 is given a driving force from driving gear 28. Input gear 30, intermediate gear 31 and primary output gear 32 are slipped idlewise on said belt-driving shaft 19, supporting shaft 29 fixed to frame sides 7 and roller-driving shaft 20, respectively. Electromagnetic clutch 33 is put together with said belt-driving shaft 19 so that, when the clutch is activated by a sheet feeding commencing signal given by the electrophotographic copying machine, the driving force is transmitted from said input gear 30 to belt-driving shaft 19. Secondary output gear 34 is also fixed to the one end of belt-driving shaft 19 so as to revolve the driven gear 35 which is slipped idlewise on supporting shaft 29.

On the other hand, the base of restrain member 36 is slipped idlewise on said supporting shaft 29 so as to operate driven lever 16, and the revolving force is transmitted thereto from said secondary output gear 34 through spring clutch 37.

As shown in FIG. 2, said restrain member 36 has two arms 36*a*, 36*b* and the arm 36*a* is hooked by high tension spring 39 of which the other end is hooked by pin 38 on frame side 7. Another arm 36*b* is brought into contact with roller 40 of the above-mentioned driven lever 16. Accordingly, in the state that said electromagnetic clutch 33 is demagnetized, driven lever 16 is pushed down by restrain member 36 resisting the force energized by tension spring 15, as shown in FIG. 2, while flapping-up member 9 is descended underneath the sheet feeding table 2, as shown in FIG. 1.

Spring clutch 37 has sleeve 41 having protrusion 41*a*, and stopper 42 which is fixed to frame side 7 is confronted by said protrusion 41*a* within the span of the movement of said protrusion. Accordingly, when driven gear 35 is revolved with secondary output gear 34 by the electromagnetic clutch being excited, then arm 36*b* of restrain member 36 is retreated to the outside of the movement span of driven lever 16, as shown in FIG. 5, and in the retreated condition thereof said protrusion 41*a* lashes said stopper 42, so that the revolving motion of driven gear 35 does not energize restrain member 36 and restrain member 36 is maintained at the retreated position.

The base of ratchet member 43 is slipped idlewise on said supporting shaft 29 and supported thereon and spring 44 shown in FIG. 3 is interposingly provided between said ratchet member 43 and said restrain member 36. The ratchet member 43 has coupling 45 capable of coupling to the side surface of arm 36*b* of said restrain member 36 and said coupling 45 is constantly seated at said arm 36*b* by the force of spring 44. The ratchet member 43 is thereby driven by restrain member 36 in motion.

On the other hand, spring clutch 46 is interposingly provided between said primary output gear 32 and said roller driving shaft 20 and plural teeth 48 are formed on the circumferential surface of sleeve 47 of said spring clutch 46. When the restrain member 36 is in the revolvable position as shown in FIG. 2, clutch 43*a* is confronted with said teeth 48 within the range of the motion of the teeth, so as to arrest the revolution of roller driving shaft 20 by coupling to said teeth 48. Accordingly, when restrain member 36 is in the revolvable position where driven lever 16 is released as shown in FIG. 5, ratchet 43*a* is disengaged from teeth 48 and the revolving motion of primary output gear 32 is thus transmitted to roller-driving shaft 20.

In the above example, when there is no sheet feeding commencement signal given, driven lever 16 is pushed down to the position indicated in FIG. 2 by restrain member 36 and flapping-up member 9 is thus in its descended position. Accordingly, in this state, sheet feeding cassette 4 is freely detachable from sheet feeding table 2 and the detaching operation can be performed simply by moving the sheet feeding cassette 4 by hand.

Next, at the moment when a sheet feeding commencement signal is once given by an electrophotographic copying machine body, electromagnetic clutch 33 is then excited, so that a revolving motion is transmitted by driving gear 28 from constantly revolving input gear 30 to belt-driving shaft 19 and thus conveyor belt 23 is driven by driving pulley 21. At the same moment, secondary output gear 34 of belt-driving shaft 19 is revolved and restrain member 36 is revolved in the direction of the arrow indicated in FIG. 2, resisting the force energized by high tension spring 39, through driven gear 35 which engages said secondary output gear 34 and spring clutch 37. Incidentally, driven lever 16 is sprung up by the force of tension spring 15 toward the position shown in FIG. 5, so that flapping-up member 9 flaps up bottom plate 5 of sheet feeding cassette 4 as illustrated in FIG. 4.

As mentioned above, when recording sheet X in sheet feeding cassette 4 is brought into pressure contact with sheet feeding roller 24, protrusion 41*a* of sleeve 41 hits stopper 42, so that spring clutch 37 is released and restrain member 36 is thus kept at the same position. Then, ratchet 43*a* of ratchet member 43 which is driven according to the motion of restrain member 36 is disengaged from teeth 48 of spring clutch 46. Accordingly, the revolving motion of primary output gear 32 which is constantly revolving is transmitted to roller driving shaft 20 through spring clutch 46 and thus sheet feeding roller 24 commences to revolve. As the result thereof, recording sheet X in sheet feeding cassette 4 is drawn out by sheet feeding roller 24 and the upper-most recording sheet X is sent out after another to sheet feeding passage 17.

When the feeding of recording sheets is completed, the sheet feeding commencement signal is terminated and demagnetizes electromagnetic clutch 33. The revolving force of driven gear 35 is eliminated, so that restrain member 36 and driven lever 16 are restored by the force of tension spring 39 to the position indicated in FIG. 2. Therefore, flapping-up member 9 restores to the position indicated in FIG. 1, so that it becomes possible to extract freely sheet feeding cassette 4 from sheet feeding table 2 and to couple ratchet 43*a* to teeth 48 of spring clutch 46, so that sheet feeding roller 24 stops its motion. As the result thereof, replacement of the sheet feeding cassette can freely be made.

As is apparent from the above description, according to the present invention, it is not required to operate a manual lever every time when a sheet feeding cassette is inserted in or detached from a sheet feeding table as in the past, nor to affect a sheet feeding cassette by a strong resistance at the time of insertion or detachment thereof. Accordingly, with a sheet feeding means of the invention, the replacement of a sheet feeding cassette can be performed only by handily inserting or detaching the sheet feeding cassette, so that the operation of the means becomes so simple that even those who are little acquainted can perform the operation without failure. Even in a case of jamming as the flapping-up member 9 is drawn back by demagnetizing electromagnetic clutch 33, sheet feeding cassette 4 is freely detachable from sheet feeding table 2.

In the above example, an embodiment of the invention is applied to the sheet feeding section of an electrophotographic copying machine, and it is however obvious that the invention can be applied also to the sheet feeding means of other recording apparatuses.

What is claimed is:

1. In a sheet feeding means having a mechanism to flap up a bottom plate of a sheet feeding cassette loaded on to a sheet feeding table by means of a flapping-up member which is incorporated into said sheet feeding table, the improvement comprising:

said flapping-up member being energized by a low tension biasing member in the direction of a flapping-up position, a restraining member energized by a high tension biasing member in the direction of restraining said flapping-up member at a retracted position in said sheet feeding table, and a sheet feeding drive for driving a sheet feeding operation in response to a sheet feeding signal, wherein said flapping-up member is restrained by said restraining member in said retracted position when no sheet feeding signal is given, and is released from said restraining member when the sheet feeding signal is given, whereby said flapping-up member is operated to flap up said bottom plate only during a sheet feeding operation.

2. The improvement as said forth in claim 1, wherein said sheet feeding drive includes a spring clutch, and said restraining member is energized to overcome said high tension biasing member in the direction of releasing said flapping-up member by engagement of said spring clutch of said sheet feeding drive in response to said sheet feeding signal.

* * * * *